US005906165A

United States Patent [19]

McCorkle, Jr. et al.

[11] Patent Number: 5,906,165

[45] Date of Patent: May 25, 1999

[54] STACKABLE TRAY FOR PLANTS

[75] Inventors: Donald E. McCorkle, Jr., Dearing; Stephen K. Giddens, Warrenton, both of Ga.

[73] Assignee: The McStack Company, Marietta, Ga.

[21] Appl. No.: 08/821,731

[22] Filed: Mar. 20, 1997

Related U.S. Application Data

[60] Provisional application No. 60/013,732, Mar. 20, 1996.

[51] Int. Cl.[6] ..... B65D 19/44

[52] U.S. Cl. ..... 108/55.1; 108/53.1

[58] Field of Search ..... 108/55, 61, 51.11, 108/55.1

[56] References Cited

U.S. PATENT DOCUMENTS

| | | | |
|---|---|---|---|
| 2,941,771 | 6/1960 | Sim | 108/55.1 X |
| 3,735,713 | 5/1973 | Glassmeyer | 108/55.1 X |
| 4,261,470 | 4/1981 | Dolan | 108/55.1 X |
| 5,348,149 | 9/1994 | McCarthy | 108/55.1 X |
| 5,388,532 | 2/1995 | Wakano | 108/55.1 |
| 5,507,237 | 4/1996 | Barrow et al. | 108/55.1 |

*Primary Examiner*—Jose V. Chen

*Attorney, Agent, or Firm*—Dickinson Wright PLLC

[57] ABSTRACT

A tray for the transport of nursery plants and the like has a bottom and movable side walls. The side walls may be easily placed in one of three positions. When in the lowermost position, the side wall is even with or below the bottom for allowing plants to be loaded or unloaded. After plants are loaded, the side wall is placed in middle or upper positions to retain the plants on the tray during transport. The side walls are retained on the tray by brackets that are configured to prevent dislodgment during vertical motions incident to bouncing of the vehicle during transport.

7 Claims, 2 Drawing Sheets

STACKABLE TRAY FOR PLANTS

This application claims priority of provisional application Ser. No. 60/013,732, which was filed on Mar. 20, 1996.

TECHNICAL FIELD

This invention relates to the art of devices for carrying objects. In particular, the device is movable tray for carrying plants that is easily transported and inexpensively manufactured.

BACKGROUND

Transportable trays are known. One such tray, shown in U.S. Pat. No. 5,233,931 (McCorkle, Jr.) is specifically designed for transport of plants and includes a generally flat bottom and foldable side walls. The side walls are held in vertical positions during shipping to retain the plants and are supported in horizontal positions during display to provide additional shelf space for display of the plants. These trays are supported by foot elements that are capable of engaging vertical posts on other such trays, whereby the trays may be stacked on each other.

Manufacture of trays such as those shown in the '931 patent is somewhat expensive, and provision for the side walls to be held in the horizontal position is not always necessary. Accordingly, it is an object of this invention to provide a tray that is effective for transporting plants and yet is comparatively inexpensive.

SUMMARY OF THE INVENTION

In accordance with the invention, a transportable tray comprises a generally flat, rectangular bottom supported by a foot element at each corner. An upstanding post is mounted to the bottom at each corner to support end and side walls and to permit another such tray to be stacked on top. The tray also includes brackets (pockets) below the sides and the ends of the bottom for engaging the tines of a forklift to facilitate movement of the tray from the nursery to the transport truck and from the truck to the retail florist or the florist's warehouse.

Each of the side walls is individually movable to a selected one of three vertical positions. In a first position, the top of a side wall is even with the bottom of the tray while the remainder of the side wall extends below the bottom. In this position, plants may be loaded easily onto the bottom or removed from it. In a second position, the wall extends upward from a location near the bottom to retain shorter plants on the tray during shipping. In a third position, the wall extends upward from a location somewhat above the bottom to retain taller plants on the tray during shipping.

In the preferred embodiment, the forklift brackets extend forward from the front edge of the bottom such that they protrude between horizontal bars of the movable side walls by a distance that prevents accidental engagement between a forklift and the side wall to prevent damage to the side wall.

The side walls are held to the tray by a series of brackets, one of which engages one side of a side wall and the other two of which selectively engage the other side of the side wall for allowing the side walls to be placed in a selected one of the three positions noted above. The two brackets that engage the other side wall permit disengagement of the side wall only when the side wall is in an outward orientation, preferably horizontal to prevent accidental disengagement of the side wall, as by bouncing during transport.

DETAILED DESCRIPTION OF THE PREFERRED EMBODIMENT

Figure 1:
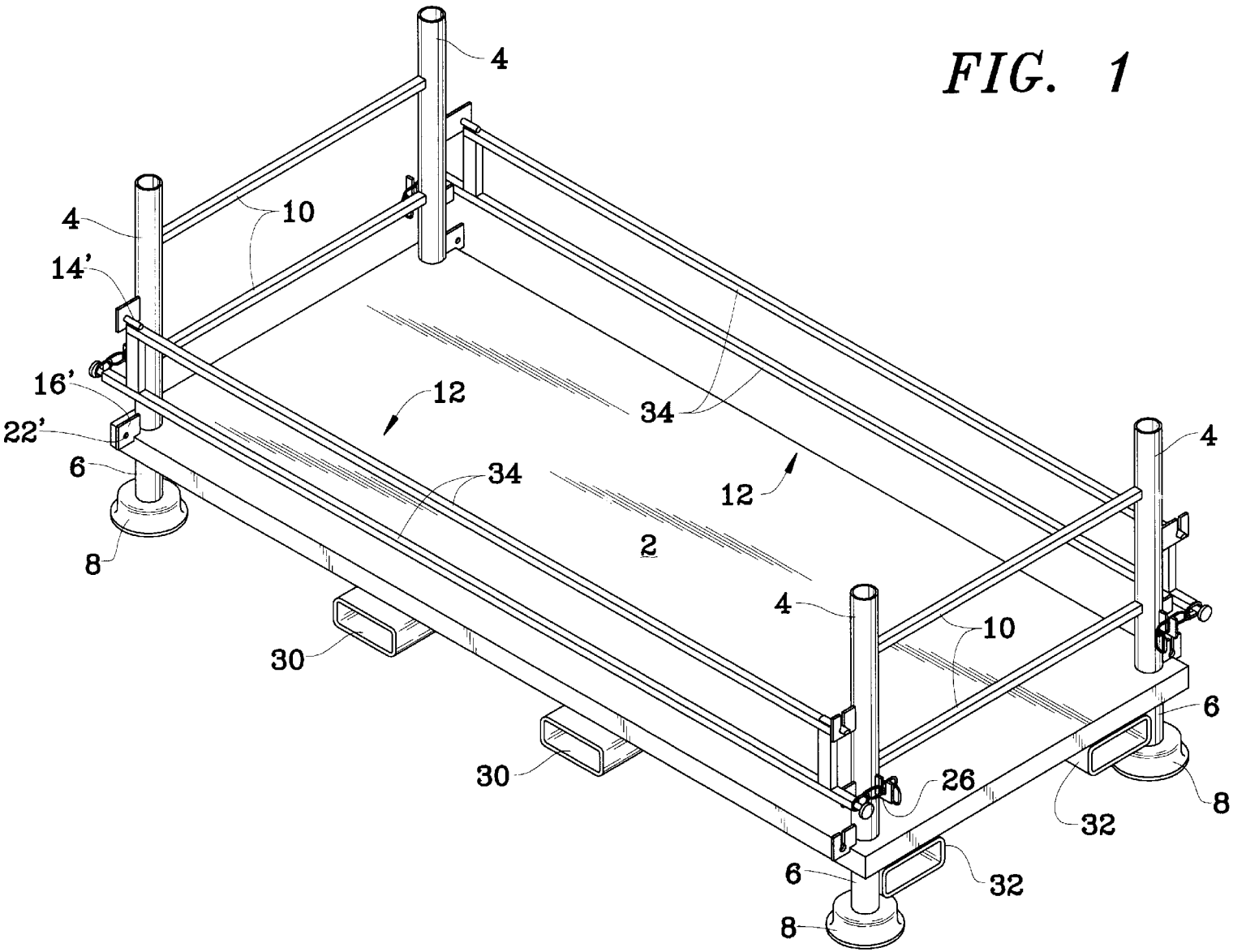
FIG. 1 is a perspective of a tray in accordance with the invention.

FIG. 1 shows a preferred embodiment of a tray in accordance with the invention. The tray includes a generally flat bottom 2 for receiving merchandise to be shipped, such as nursery plants (not shown). An upstanding post 4 is attached to the bottom at, or near, each corner, and a depending post 6 is also attached at each corner. A support foot 8 is attached to the bottom of each depending post to provide a foundation for supporting the tray on the ground. The feet 8 are hollow on the interior and are designed to engage the top of a post 4 when one tray is stacked on another. The posts 4 and 6 may be continuous whereby they extend through openings in the bottom 2, or they may be separate elements attached to the bottom. The latter arrangement allows the bottom of the tray to be used for other trays, such as the tray shown in the aforementioned U.S. Pat. No. 5,233,931.

A pair of cross bars 10 extends between the posts 4 at the ends of the tray to provide a barrier to objects, such as the nursery plants, to retain them on the tray during transport. Side walls 12 are attached to the posts 4 on the front and the rear also to retain objects on the bottom during transport of the tray. The side walls, however, are movable such that they may be placed in a selected one of three positions.

Figure 2:
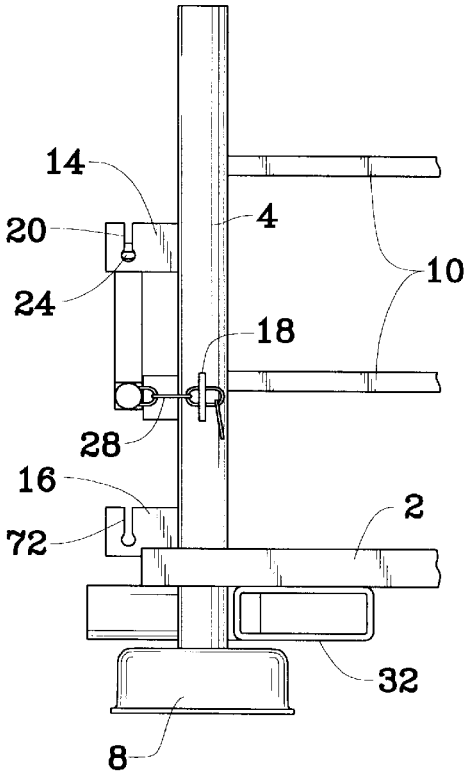
FIG. 2 is a partial end view showing a side wall in an upper position.
Figure 3:
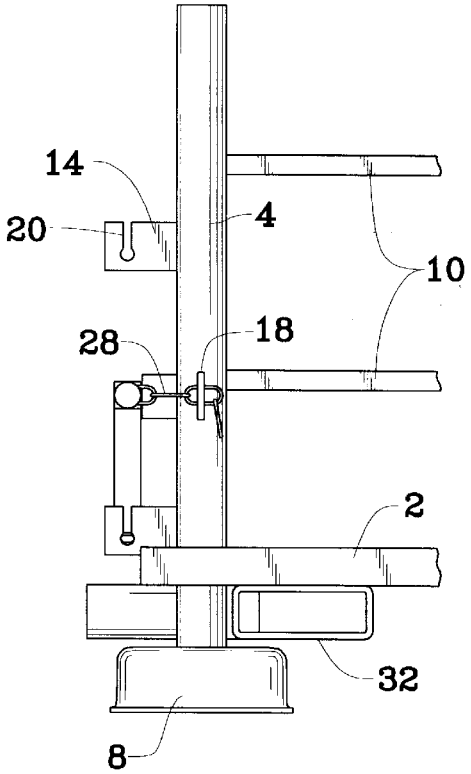
FIG. 3 is a partial end view showing a side wall in a middle position.

In the first position, shown in FIGS. 1 and 2, the side wall is in its uppermost position. This upper position of the side wall is used to retain taller or double-stacked plants on the tray. A mid-level position is illustrated in FIG. 3, which is used to retain shorter plants on the tray. In the third position, illustrated in FIG. 4, the side wall extends below the bottom 4 to allow the plants to be easily placed on or removed from the bottom. In this position, the upper edge of the side wall is even with the bottom surface to facilitate loading and unloading of plants.

Figure 4:
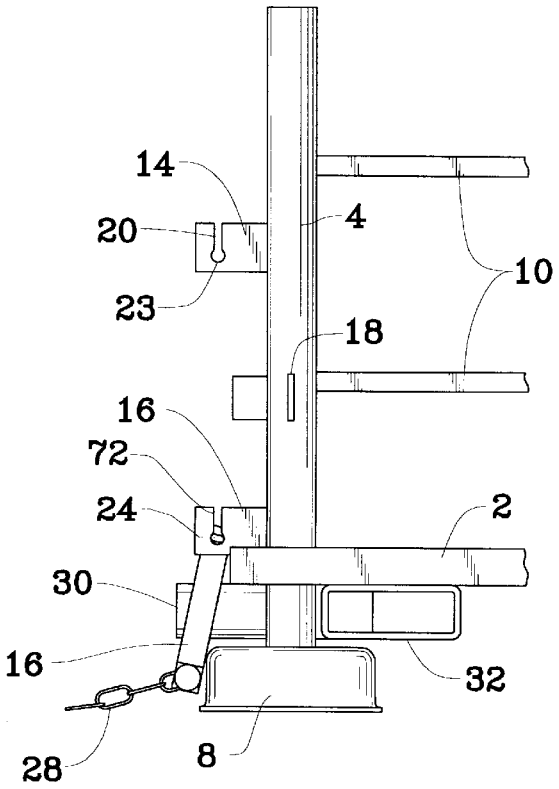
FIG. 4 is a partial end view showing a side wall in a lower position.

The side walls are attached to the tray by structure that essentially allows the side wall to roll over as it moves between the three positions. To accomplish this, an upper bracket 14, a lower bracket 16, and a mid-level pivot connection are provided on each of the posts 4. The upper and lower brackets are of two types. The upper and lower brackets shown in FIGS. 2 through 4 are on one end of the tray and have respective notches 20 and 22 for receiving a pin 24 on the side wall. Each of the upper and lower brackets 14' and 16' on the other end of the tray has only a hole 22' for receiving the pin 24. The slots 20 and 22 are narrow and terminate in a broad end 23. The pin 24 is oblong in cross section, being about as tall as the slots 20 and 22 are wide (e.g., one-fourth inch) and about as wide as the end 23 (e.g., one inch). Thus, the pin 24 can be slid through the slot only when it is in a certain orientation. Preferably, that orientation is such that the side wall is about horizontal. This prevents the side wall from moving vertically, which prevents it from being released as a result of vertical motions of the truck carrying the tray.

The pivot 18 includes a slot 26 (see FIG. 1) for engaging a link of a chain 28. The chain is attached to the side of the side wall opposite the side having the pin 24.

Thus, the side wall may be placed in any of the three positions very easily. To place the side wall in the upper position, the chain 28 is released from the slot 26, the side wall is held in an approximate horizontal orientation, and pin 24 on one side of the tray is placed in the hole 26', pin 24 on the other side of the tray is placed in slot 20, and the tray is lowered to a vertical orientation to allow engagement of the chain 28 in the slot 26. The completed assembly with the side wall in the upper position is shown in FIG. 2. The side wall is placed in the middle position by disengaging the chain 28, lifting the side wall such that the pins 24 are released from the slot 20 and the hole 22'. As noted the side wall will be horizontal during this process. Then the pins 24 are engaged in the brackets 16 and 16' by the process described above with regard to brackets 14 and 14', and the chain is again engaged in the slot 26.. The result of this process is shown in FIG. 3. The side wall is moved to the lowest position by releasing the chain 28 from the slot 26 and pivoting the side wall about the pins in the hole 22' and end 23 to allow it to assume the position shown in FIG. 4.

The side wall is illustrated in FIG. 4 as being tilted outward slightly, and it will be appreciated that the position of the foot may be further inward whereby the side wall is vertical when in the lowest position.

The tray may be easily moved about by a known forklift (not illustrated). The tines of the forklift are received in brackets 30 on the sides or brackets 32 on the ends. It will be appreciated that the bars 34 of the side walls are arranged such that they lie on opposite sides of the brackets 30 when the side wall is in the lowest position to avoid interference with the forklift. Also, the forklift pockets 30, on the front and rear of the tray, extend beyond the front edge of the bottom by a distance whereby it will extend beyond the side wall when the side wall is in the lowermost position as shown in FIG. 4. This configuration prevents accidental damage of the side wall by ramming with the forklift.

While the tray has been illustrated as rectangular, it will be appreciated that other shapes, including square or circular may be useful. In addition, the tray is preferably made of metal for strength, but it could as well be made of other materials.

It will be appreciated that a unique tray for transporting taller or shorter plants has been described. Modifications within the scope of the appended claims will be apparent to those of skill in the art.

We claim:

1. A tray for receiving articles to be transported comprising:

a generally flat bottom for receiving the articles to be transported, a first plurality of spaced posts extending upward from said bottom by a predetermined distance, a second plurality of spaced posts extending downward from said bottom, a unitary sidewall having a fixed height that is less than said first distance and comprising structure for retaining said articles and being movable with respect to said first plurality of spaced posts, and bracket means mounted to said first plurality of spaced posts for securing said sidewall to said first plurality of posts at an upper position, a middle position, or a lower position, said bracket means comprising an upper set of brackets for receiving an upper side of said sidewall when said sidewall is in said upper position, a middle set of brackets for receiving a lower side of said sidewall when said sidewall is in said upper position and is in said middle position, and a lower set of brackets for receiving said upper side of said sidewall when said sidewall is in said middle position and is in said lower position.

2. A tray according to claim 1 wherein said upper brackets comprise a plate having a slot with an enlarged end for receiving a pin having an oblong cross section in only a predetermined orientation.

3. A tray according to claim 2 wherein said middle brackets comprise a plate with a slot for engaging a chain.

4. A tray according to claim 2 wherein said side wall further comprises a pin for engaging said slot, the cross sectional dimensions of said pin being such that said pin will pass through said slot and enter said enlarged end only when said side wall is in a predetermined orientation.

5. A tray according to claim 1 further comprising means for engaging a forklift, wherein said means for engaging a forklift is below said bottom and extends outwardly from the front edge of said bottom by a distance that prevents engagement between said forklift and said side wall when said side wall is in said lower position.

6. A tray according to claim 5 wherein said structure for retaining said articles of said side wall forms an opening that aligns with said means for engaging a forklift when said side wall is in said lower position and allows passage of tines on said forklift through said opening and to said means for engaging a forklift.

7. A tray according to claim 1 wherein said upper set of brackets comprises two plates, each of which has an opening therein for receiving a pin on said sidewall, said middle set of brackets comprise two plates, each of which has a slot for engaging a chain on said sidewall, and said lower set of brackets comprises two plates, each of which has an opening therein for receiving said pin on said sidewall, and said sidewall further includes a said pin on respective opposed ends of said upper side and a said chain on opposed respective ends of said lower side.

* * * * *